US011845632B2

(12) United States Patent
Lee

(10) Patent No.: US 11,845,632 B2
(45) Date of Patent: Dec. 19, 2023

(54) METHOD OF PREDICTIVELY MAINTAINING ELEVATOR DRIVING UNIT

(71) Applicant: ITS CO., LTD., Ulsan (KR)

(72) Inventor: Youngkyu Lee, Ulsan (KR)

(73) Assignee: ITS CO., LTD., Ulsan (KR)

( * ) Notice: Subject to any disclaimer, the term of this patent is extended or adjusted under 35 U.S.C. 154(b) by 1279 days.

(21) Appl. No.: 16/389,648

(22) Filed: Apr. 19, 2019

(65) Prior Publication Data

US 2019/0300334 A1 Oct. 3, 2019

Related U.S. Application Data

(63) Continuation of application No. PCT/KR2018/007315, filed on Jun. 27, 2018.

(30) Foreign Application Priority Data

Nov. 13, 2017 (KR) ..... 10-2017-0150458

(51) Int. Cl.
*B66B 5/00* (2006.01)

(52) U.S. Cl.
CPC ..... *B66B 5/0025* (2013.01); *B66B 5/0031* (2013.01); *B66B 5/0037* (2013.01); *B66B 2201/402* (2013.01)

(58) Field of Classification Search
CPC ... B66B 5/0025; B66B 5/0031; B66B 5/0037; B66B 2201/402
See application file for complete search history.

(56) References Cited

U.S. PATENT DOCUMENTS

2018/0334363 A1* 11/2018 Saarela ..... B66B 13/02
2019/0300335 A1* 10/2019 Lee ..... B66B 5/0012
2020/0109025 A1* 4/2020 Simcik ..... B66B 1/3407

FOREIGN PATENT DOCUMENTS

| | | | |
|---|---|---|---|
| CN | 101513970 | A | 8/2009 |
| CN | 104176576 | A | 12/2014 |
| CN | 104843555 | A | 8/2015 |
| JP | H06-16361 | A | 1/1994 |
| JP | 2003-348890 | A | 12/2003 |
| JP | 2004-133553 | A | 4/2004 |
| JP | 2007-168937 | A | 7/2007 |
| JP | 2007-223749 | A | 9/2007 |
| JP | 2009-196778 | A | 9/2009 |
| KR | 1997-0042196 | A | 7/1997 |
| KR | 2000-0020216 | A | 4/2000 |

* cited by examiner

*Primary Examiner* — Jeffrey Donels
(74) *Attorney, Agent, or Firm* — Studebaker & Brackett PC

(57) ABSTRACT

The present invention provides a method of predictively maintaining an elevator driving unit which distinguishes between a condition when moving an elevator upward and a condition when moving the elevator downward, collects driving information of the driving unit (information on a change over time in current values) in a normal state, collects driving information of the driving unit before the occurrence of breakdown, sets critical levels based on the collected information, detects in real time an abnormal symptom of the driving unit by comparing the driving information of the driving unit, which is collected in real time, with the set critical level, and then performs stable predictive maintenance of the elevator driving unit, thereby efficiently preventing a safety accident of the elevator caused by a breakdown of the elevator driving unit.

2 Claims, 10 Drawing Sheets

METHOD OF PREDICTIVELY MAINTAINING ELEVATOR DRIVING UNIT

CROSS-REFERENCE TO RELATED APPLICATIONS

The present application is a continuation of International Patent Application No. PCT/KR2018/007315, filed Jun. 27, 2018, which is based upon and claims the benefit of priority to Korean Patent Application No. 10-2017-0150458, filed on Nov. 13, 2017. The disclosures of the above-listed applications are hereby incorporated by reference herein in their entirety.

TECHNICAL FIELD

The present invention relates to a method of predictively maintaining an elevator driving unit, and more particularly, to a method of predictively maintaining an elevator driving unit which distinguishes between a condition when moving an elevator upward and a condition when moving the elevator downward, collects driving information of the driving unit (information on a change over time in current values) in a normal state, collects driving information of the driving unit before the occurrence of breakdown, sets critical levels based on the collected information, detects in real time an abnormal symptom of the driving unit by comparing the driving information of the driving unit, which is collected in real time, with the set critical level, and then performs stable predictive maintenance of the elevator driving unit, thereby efficiently preventing a safety accident of the elevator caused by a breakdown of the elevator driving unit.

BACKGROUND ART

In general, an elevator is installed to quickly move between floors in a multi-story building, and the installation of the elevator is continuously increased because of an increase in high-rise buildings and convenience of use. In Korea, about 25,000 elevators are newly installed every year, and about 2 million elevators are expected to be installed by 2020.

The elevator broadly includes an elevator car which accommodates a passenger and moves, a driving unit which operates the elevator car through a rope, a control unit which controls the operation of the elevator, and a power supply unit which supplies power.

Here, the driving unit is a mechanical device that substantially operates the elevator. Because the elevator reciprocally and vertically moves between lower floors and upper floors, it is necessary to periodically inspect and manage the driving unit so as to easily ensure safety of the passenger.

Therefore, the elevator in the related art is regularly inspected by an expert to prevent a safety accident of the elevator. However, there is a problem in that because of a situation in which a period of inspection of the elevator is usually 2 years or less, it is difficult to predict a breakdown of the driving unit of the elevator and to maintain the driving unit, and thus it is difficult to effectively prevent a safety accident of the elevator.

Accordingly, there is an acute need for development of a method capable of predicting a breakdown of the elevator driving unit and maintaining the elevator driving unit.

Technical Problem

The present invention has been made in an effort to solve the above-mentioned various problems, and an object of the present invention is to provide a method of predictively maintaining an elevator driving unit which distinguishes between a condition when moving an elevator upward and a condition when moving the elevator downward, collects driving information of the driving unit (information on a change over time in current values) in a normal state, collects driving information of the driving unit before the occurrence of breakdown, sets critical levels based on the collected information, detects in real time an abnormal symptom of the driving unit by comparing the driving information of the driving unit, which is collected in real time, with the set critical level, and then performs stable predictive maintenance of the elevator driving unit, thereby efficiently preventing a safety accident of the elevator caused by a breakdown of the elevator driving unit.

Another object of the present invention is to provide a method of predictively maintaining an elevator driving unit, in which based on characteristics in which a driving unit is applied to an elevator, the method of predictively maintaining an elevator driving unit according to the present invention collects the current values (the driving information) of the driving unit, which change over time, while classifying the current values into the unlocked section, the activated section, the constant-speed section, the stopped section, and the locked section, detects the abnormal symptom of the driving unit by comparing the driving information of the driving unit, which is collected in real time, with the upper limit values and the lower limit values of the critical levels corresponding to the respective sections, and thus may easily detect the part (device) of the driving unit which is suspected of having the abnormal symptom, and as a result, the method of predictively maintaining an elevator driving unit according to the present invention has an effect of performing the precise predictive maintenance of the driving unit of the elevator and ensuring excellent reliability associated with the detection result regarding the elevator driving unit.

Technical Solution

To achieve the above-mentioned objects, a method of predictively maintaining an elevator driving unit includes: a first base information collecting step S10 of measuring information on a change over time in magnitudes of current values of the driving unit when the driving unit moves an elevator upward in a normal state, measuring the information on the change over time in magnitudes of current values of the driving unit when the driving unit moves the elevator downward in the normal state, classifying the measured driving information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit; a second base information collecting step S20 of measuring the information on the change over time in magnitudes of current values which is measured in an operated state of the driving unit before the driving unit breaks down when moving the elevator upward, measuring the information on the change over time in magnitudes of current values which is measured in the operated state of the driving unit before the driving unit breaks down when moving the elevator downward, classifying the measured information into information of the driving unit when moving the elevator upward and information of the driving unit when moving the elevator downward, and storing the information of the driving unit when moving the elevator upward and the information of the driving unit when moving the elevator downward as the base information of the driving unit; a setting step S30 of setting, based on the information collected in the base information collecting steps S10 and S20, critical levels of the current values over time of the driving unit when moving the elevator upward and critical levels of the current values over time of the driving unit when moving the elevator downward; and a detection step S40 which includes: a first process S41 of measuring and collecting the information on the change over time in magnitudes of current values which is measured in the operated state of the driving unit in real time when the driving unit operates; a second process S42 of identifying the upward movement or the downward movement of the elevator by comparing the measured information collected in the first process S41 with the base information collected in the first base information collecting step S10; and a third process S43 of detecting an abnormal symptom of the driving unit by comparing the critical level of the setting step S30, which corresponds to the identified information identified in the second process S42, with the measured information collected in the first process S41.

In addition, the information on the change over time in magnitudes of current values of the driving unit, which is collected in the base information collecting steps S10 and S20, is classified into an unlocked section in which a brake of the elevator is unlocked to allow the elevator to move upward or downward, an activated section in which the driving unit begins to operate to move the elevator upward or downward, a constant-speed section in which the current values of the driving unit are stabilized and maintained within a predetermined range during the process of moving the elevator upward or downward, a stopped section in which the driving unit stops operating to stop the elevator, and a locked section in which the brake of the elevator is locked, the setting step S30 sets upper limit values and lower limit values of the critical levels for the unlocked section, the activated section, the constant-speed section, the stopped section, and the locked section, and the third process S43 of the detection step S40 detects the abnormal symptom by comparing the current values over time of the driving unit, which operates in real time, with the upper limit values and the lower limit values of the critical levels for the respective sections, in which a state of the driving unit is detected as a caution state when a real time current value of the driving unit is larger than the upper limit value of the critical level or smaller than the lower limit value of the critical level in one section, a state of the driving unit is detected as a warning state when the real time current value of the driving unit is larger than the upper limit value of the critical level or smaller than the lower limit value of the critical level in two sections, and a state of the driving unit is detected as a danger state when the real time current value of the driving unit is larger than the upper limit value of the critical level or smaller than the lower limit value of the critical level in three or more sections.

Advantageous Effects

The method of predictively maintaining an elevator driving unit according to the present invention distinguishes between the condition when moving the elevator upward and the condition when moving the elevator downward, collects the driving information of the driving unit (the information on the change over time in current values) in the normal state, collects the driving information of the driving unit before the occurrence of breakdown, sets the critical levels based on the collected information, detects in real time the abnormal symptom of the driving unit by comparing the driving information of the driving unit, which is collected in real time, with the set critical level, and then performs the stable predictive maintenance of the elevator driving unit, and as a result, the method of predictively maintaining an elevator driving unit according to the present invention has an effect of efficiently preventing a safety accident of the elevator caused by a breakdown of the elevator driving unit.

In addition, based on the characteristics in which the driving unit is applied to the elevator, the method of predictively maintaining an elevator driving unit according to the present invention collects the current values (the driving information) of the driving unit, which change over time, while classifying the current values into the unlocked section, the activated section, the constant-speed section, the stopped section, and the locked section, detects the abnormal symptom of the driving unit by comparing the driving information of the driving unit, which is collected in real time, with the upper limit values and the lower limit values of the critical levels corresponding to the respective sections, and thus may easily detect the part (device) of the driving unit which is suspected of having the abnormal symptom, and as a result, the method of predictively maintaining an elevator driving unit according to the present invention has an effect of performing the precise predictive maintenance of the driving unit of the elevator and ensuring excellent reliability associated with the detection result regarding the elevator driving unit.

DESCRIPTION OF MAIN REFERENCE NUMERALS OF DRAWINGS

Figure 1:
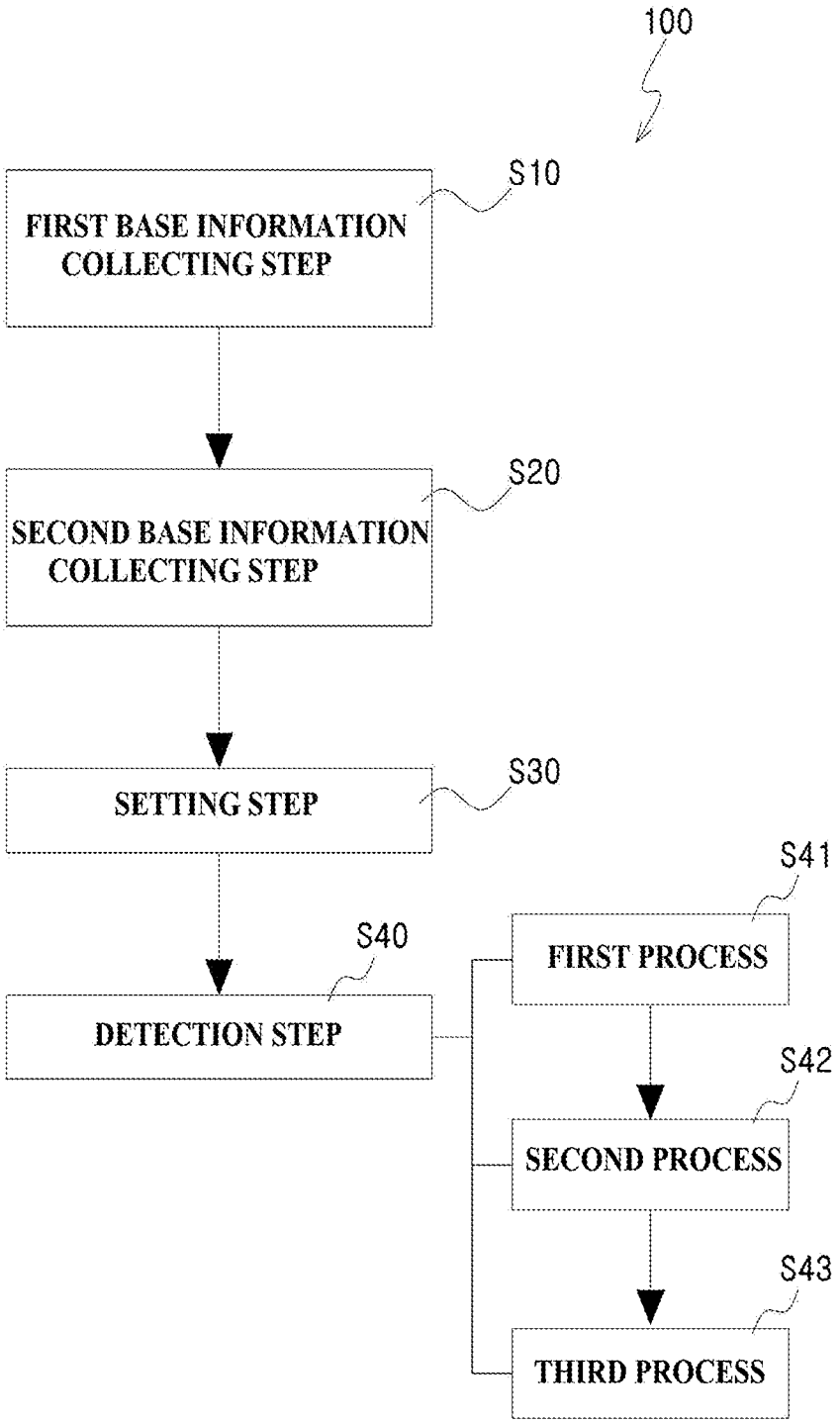
FIG. 1 is a block diagram illustrating a method of predictively maintaining an elevator driving unit according to an exemplary embodiment of the present invention.

S10: First base information collecting step
S20: Second base information collecting step
S30: Setting step
S40: Detection step
S41: First process S42: Second process
S43: Third process
100: Method of predictively maintaining elevator driving unit

SUMMARY

A method of predictively maintaining an elevator driving unit includes: a first base information collecting step S10 of measuring information on a change over time in magnitudes of current values of the driving unit when the driving unit moves an elevator upward in a normal state, measuring the information on the change over time in magnitudes of current values of the driving unit when the driving unit moves the elevator downward in the normal state, classifying the measured driving information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit; a second base information collecting step S20 of measuring the information on the change over time in magnitudes of current values which is measured in an operated state of the driving unit before the driving unit breaks down when moving the elevator upward, measuring the information on the change over time in magnitudes of current values which is measured in the operated state of the driving unit before the driving unit breaks down when moving the elevator downward, classifying the measured information into information of the driving unit when moving the elevator upward and information of the driving unit when moving the elevator downward, and storing the information of the driving unit when moving the elevator upward and the information of the driving unit when moving the elevator downward as the base information of the driving unit; a setting step S30 of setting, based on the information collected in the base information collecting steps S10 and S20, critical levels of the current values over time of the driving unit when moving the elevator upward and critical levels of the current values over time of the driving unit when moving the elevator downward; and a detection step S40 which includes: a first process S41 of measuring and collecting the information on the change over time in magnitudes of current values which is measured in the operated state of the driving unit in real time when the driving unit operates; a second process S42 of identifying the upward movement or the downward movement of the elevator by comparing the measured information collected in the first process S41 with the base information collected in the first base information collecting step S10; and a third process S43 of detecting an abnormal symptom of the driving unit by comparing the critical level of the setting step S30, which corresponds to the identified information identified in the second process S42, with the measured information collected in the first process S41.

DETAILED DESCRIPTION

A method of predictively maintaining an elevator driving unit according to an exemplary embodiment of the present invention will be described in detail with reference to the accompanying drawing. Descriptions of publicly known related functions or configurations will be omitted when it is determined that the specific descriptions may unnecessarily obscure the subject matter of the present disclosure.

FIG. 1 is a block diagram illustrating a method of predictively maintaining an elevator driving unit according to an exemplary embodiment of the present invention.

As illustrated in FIG. 1, a method 100 of predictively maintaining an elevator driving unit according to an exemplary embodiment of the present invention includes a first base information collecting step S10, a second base information collecting step S20, a setting step S30, and a detection step S40.

The first base information collecting step S10 is a step of measuring information on a change over time in magnitudes of current values of the driving unit when the driving unit moves an elevator upward in a normal state, measuring information on the change over time in magnitudes of current values of the driving unit when the driving unit moves the elevator downward in the normal state, classifying the measured information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit.

Here, the elevator is a structure that moves continuously upward or downward between lower floors and upper floors. Because the elevator is moved upward or downward by power of the driving unit, the driving information of the driving unit (the information on the change over time in magnitudes of current values), which is collected in the first base information collecting step S10, may be collected by being classified into the driving information of the driving unit when moving the elevator upward and the driving information of the driving unit when moving the elevator downward.

Figure 2:
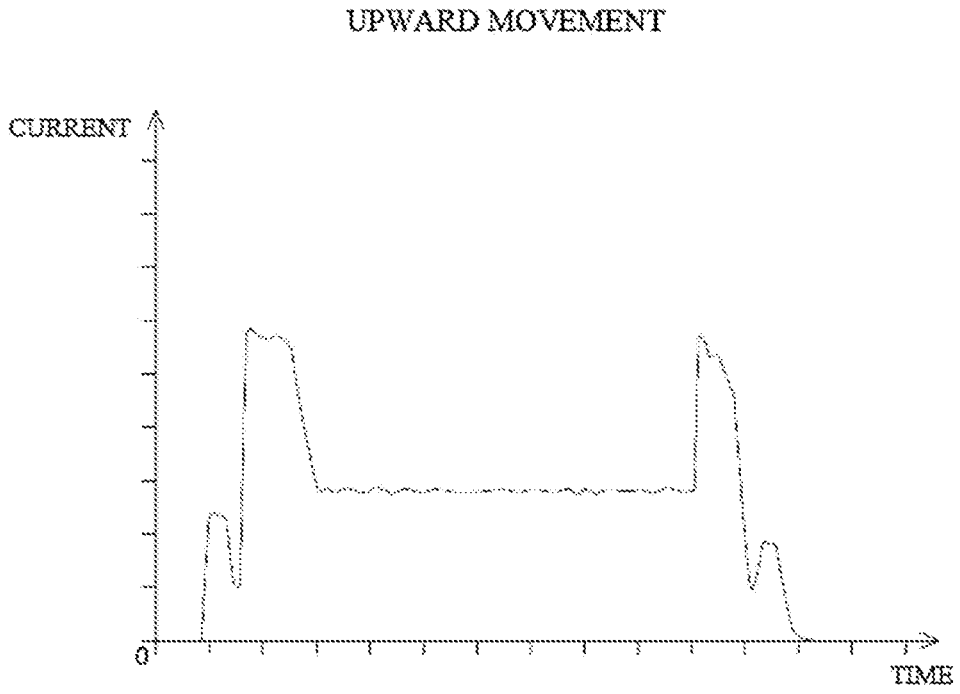
FIG. 2 is a graph illustrating current values over time of driving unit when moving elevator upward.

FIG. 2 is a graph illustrating current values over time of driving unit when moving elevator upward.

Figure 3:
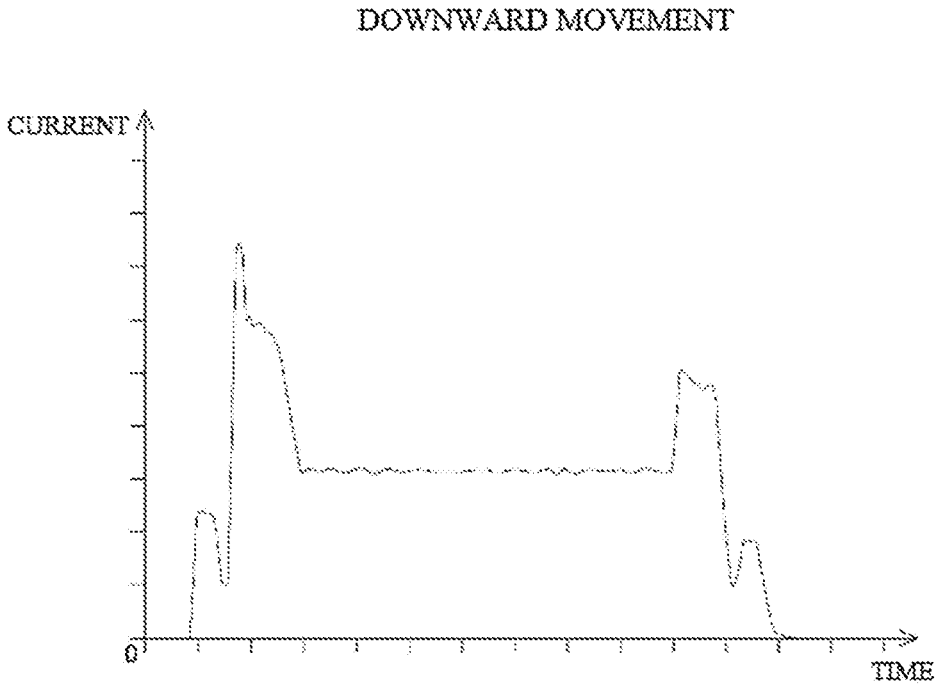
FIG. 3 is a graph illustrating current values over time of driving unit when moving elevator downward.

FIG. 3 is a graph illustrating current values over time of driving unit when moving elevator downward.

As illustrated in FIGS. 2 and 3, a value of current required for the driving unit when moving the elevator downward is somewhat higher than a value of current required for the driving unit when moving the elevator upward and these values are different in shape of the waves.

That is different from each other, it is necessary to distinguish between the condition for moving the elevator upward and the condition for moving the elevator downward and to collect and compare the pieces of driving information of the driving unit in order to clearly detect an abnormal symptom of the driving unit in real time in the detection step S40 to be described below.

Therefore, the first base information collecting step S10 collects the driving information of the driving unit in the normal state while distinguishing between the driving information of the driving unit when moving the elevator upward and the driving information of the driving unit when moving the elevator downward.

Figure 4:
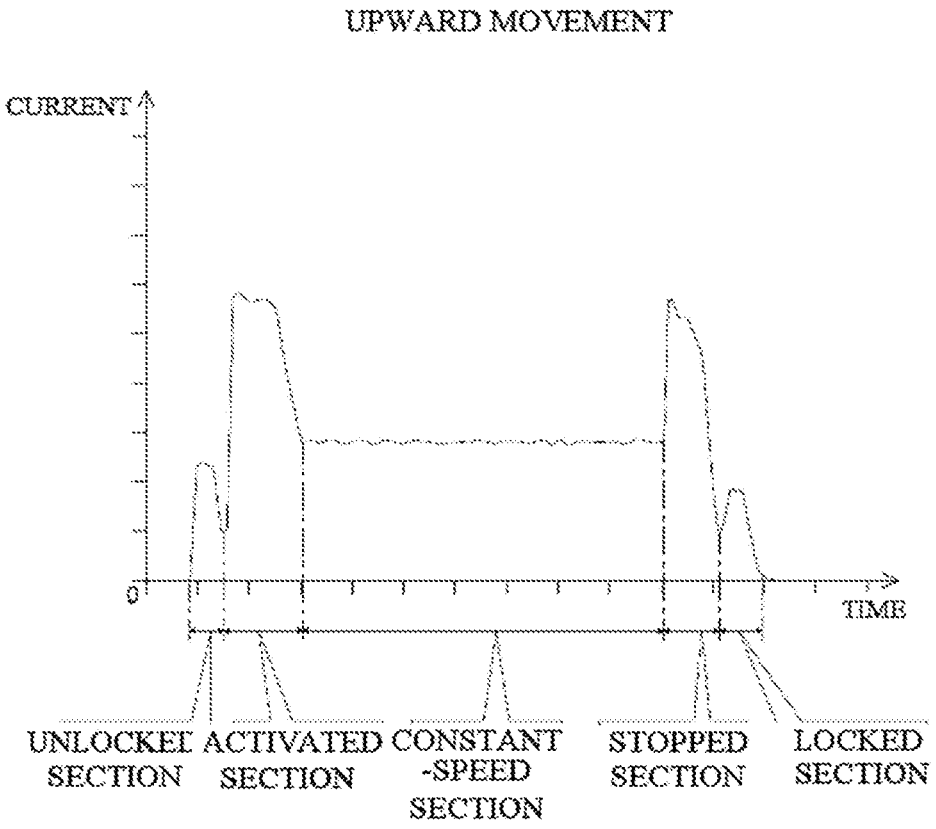
FIG. 4 is a graph illustrating current values over time of driving unit when moving elevator upward.

Meanwhile, a process of starting and stopping the elevator between one floor and another floor will be described in a stepwise manner. The process may include a first step of unlocking a brake of the elevator, a second step of initially operating the driving unit to move the elevator upward or downward, a third step of moving the elevator to another floor by using the driving unit, a step of stopping the driving unit when the operation of moving the elevator is completed, and a fifth step of locking the brake of the elevator. FIG. 4 is a graph illustrating current values over time of driving unit when moving elevator upward.

Figure 5:
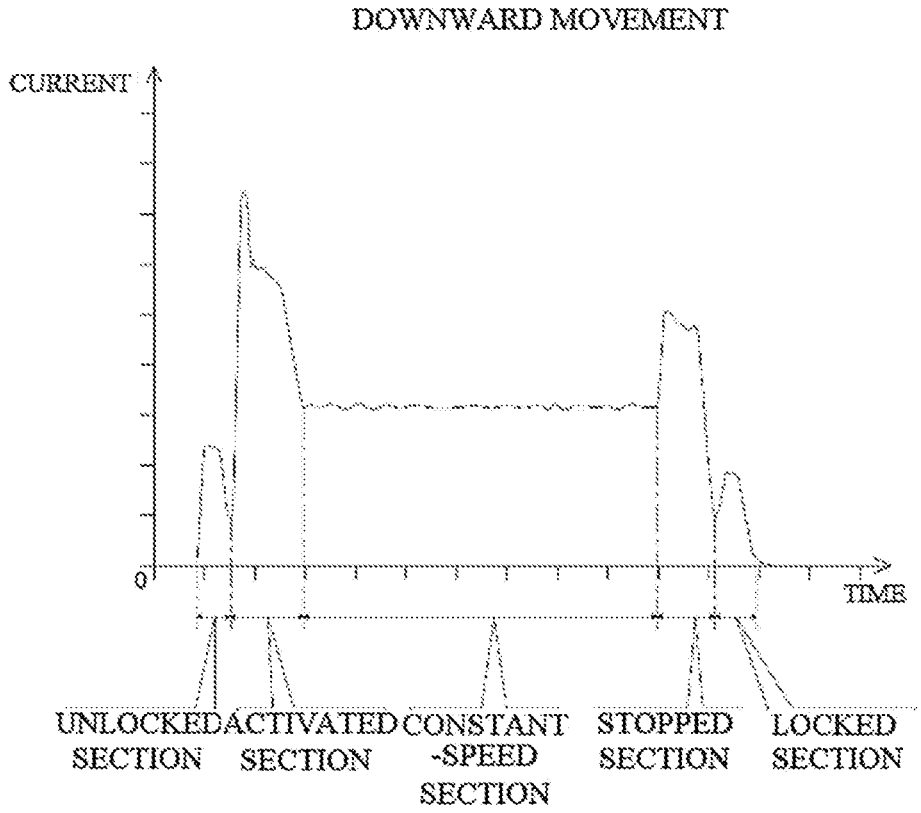
FIG. 5 is a graph illustrating current values over time of driving unit when moving elevator downward.

FIG. 5 is a graph illustrating current values over time of driving unit when moving elevator downward.

To clearly detect the abnormal symptom of the driving unit by the characteristics of the method 100 of predictively maintaining an elevator driving unit according to the present invention that detects the abnormal symptom of the elevator driving unit, the driving information is collected by classifying the information on the change over time in magnitudes of current values of the driving unit, which is collected in the first base information collecting step S10, into an unlocked section in which the brake of the elevator is unlocked to allow the elevator to move upward or downward, an activated section in which the driving unit begins to operate to move the elevator upward or downward, a constant-speed section in which the current values of the driving unit are stabilized and maintained within a predetermined range during the process of moving the elevator upward or downward, a stopped section in which the driving unit stops operating to stop the elevator, and a locked section in which the brake of the elevator is locked, as illustrated in FIGS. 4 and 5.

Meanwhile, the range of the current values, which are recognized as being in the constant-speed section, may of course be variously set in consideration of conditions such as a size and a capacity of the elevator.

The information, which is collected as described above, serves as a basis of critical level reference values (upper and lower limit values) which are set for detecting the abnormal symptom of the elevator driving unit in the setting step S30 and detection step S40 which will be described below.

The second base information collecting step S20 is a step of measuring the information on the change over time in magnitudes of current values which is measured in the operated state of the driving unit before the driving unit breaks down when moving the elevator upward, measuring the information on the change over time in magnitudes of current values which is measured in the operated state of the driving unit before the driving unit breaks down when moving the elevator downward, classifying the measured information into information of the driving unit when moving the elevator upward and information of the driving unit when moving the elevator downward, and storing the information of the driving unit when moving the elevator upward and the information of the driving unit when moving the elevator downward as the base information of the driving unit.

Here, the current values over time of the driving unit, which are collected in the second base information collecting step S20, are also classified into the unlocked section, the activated section, the constant-speed section, the stopped section, and the locked section like in the first base information collecting step S10, such that the driving information is collected.

The information, which is collected in this manner, also serves as a basis of the critical level reference values (upper and lower limit values) which are set for detecting the abnormal symptom of the elevator driving unit in the setting step S30 and detection step S40.

The setting step S30 is a step of setting, based on the information collected in the base information collecting steps S10 and S20, critical levels of the current values over time of the driving unit when moving the elevator upward and critical levels of the current values over time of the driving unit when moving the elevator downward.

Figure 6:
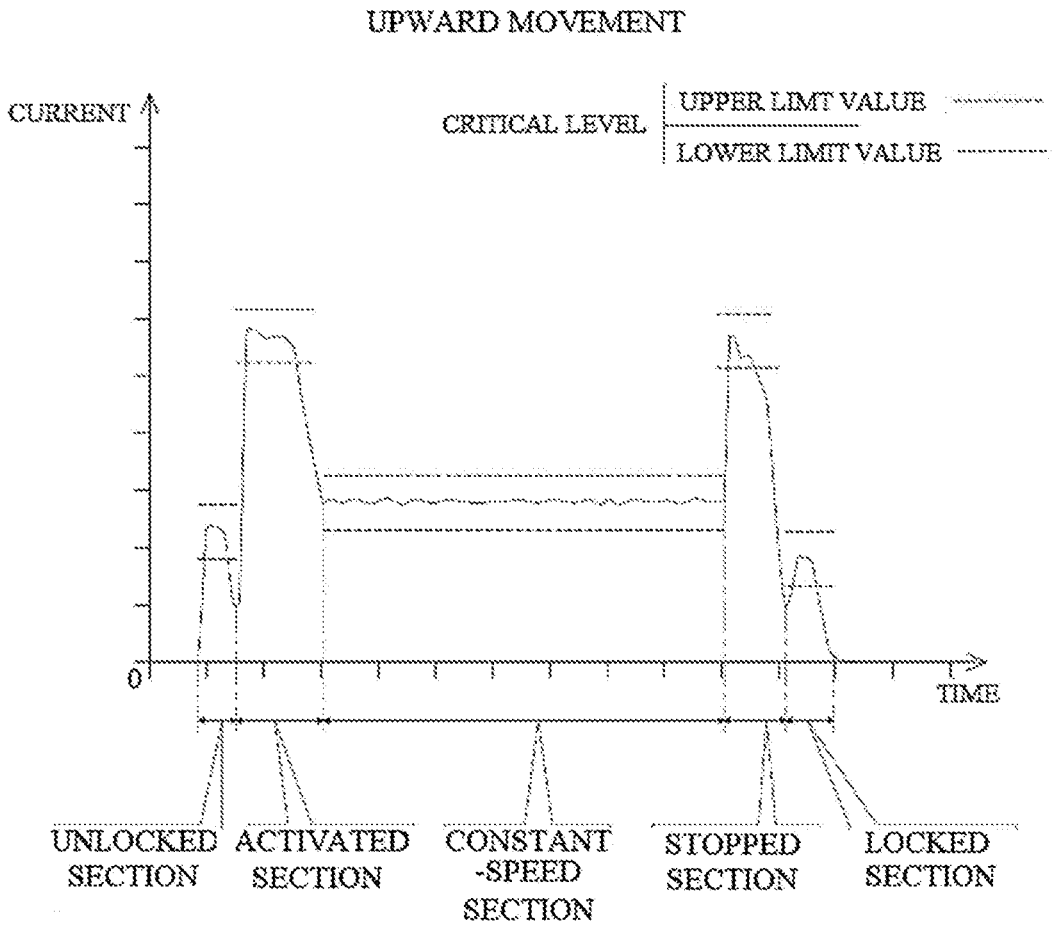
FIG. 6 is a graph illustrating critical levels of driving unit when moving elevator upward.

FIG. 6 is a graph illustrating critical levels of driving unit when moving elevator upward.

Figure 7:
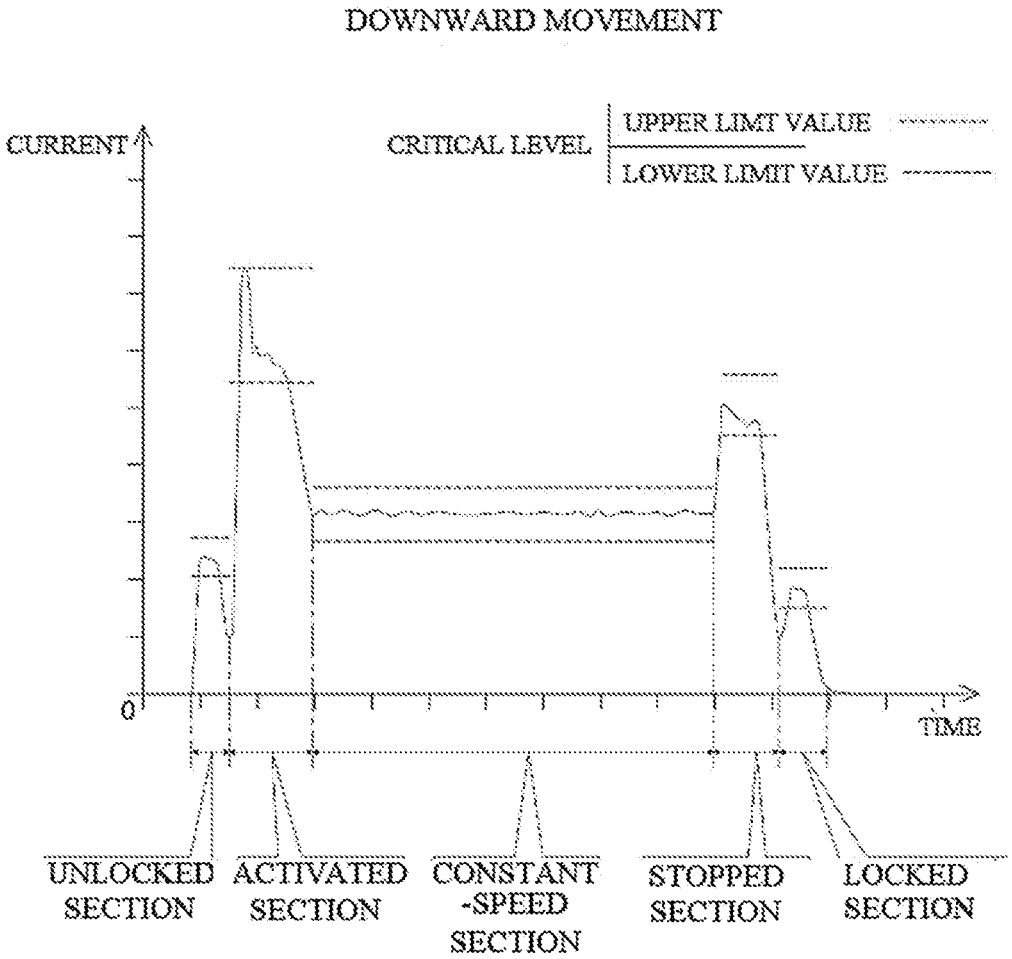
FIG. 7 is a graph illustrating critical levels of driving unit when moving elevator downward.

FIG. 7 is a graph illustrating critical levels of driving unit when moving elevator downward.

As illustrated in FIGS. 6 and 7, the setting step S30 sets upper limit values and lower limit values of the critical levels of the driving unit in the unlocked section, the activated section, the constant-speed section, the stopped section, and the locked section when moving the elevator upward and when moving the elevator downward.

The detection step S40 detects the abnormal symptom of the driving unit which operates in real time through a first process S41, a second process S42, and a third process S43.

The first process S41 is a process of collecting in real time the driving information of the driving unit in order to detect the abnormal symptom of the driving unit when the driving unit operates to operate the elevator.

The second process S42 is a process of identifying the upward movement or the downward movement of the elevator by comparing the measured information collected in the first process S41 and the base information collected in the first base information collecting step S10.

That is, there occurs a difference between the current values of the driving unit when moving the elevator upward and the current values of the driving unit when moving the elevator downward as described above, and thus the upward movement or the downward movement of the elevator is simply identified based on the current values of the driving unit collected in real time depending on the information which is collected by being classified into the information when moving the elevator upward and the information when moving the elevator downward in the first base information collecting step S10.

The third process S43 is a process of detecting the abnormal symptom of the driving unit by comparing the measured information collected in the first process S41 and the critical level of the setting step S30 which corresponds to the identified information identified in the second process S42.

As an example, in the second process S42, the operation of the driving unit is identified as being performed to move the elevator upward, the third process S43 detects the abnormal symptom of the driving unit, which operates in real time, by comparing the driving information of the driving unit, which is collected in real time, and the critical level of the driving unit which is set as a condition when moving the elevator upward in the setting step S30.

Figure 8:
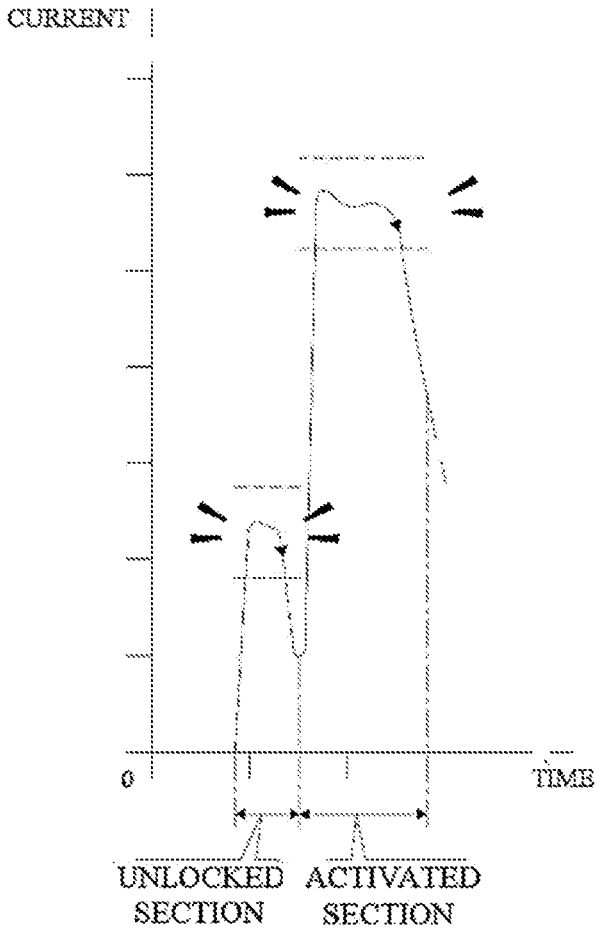
FIG. 8 is a graph illustrating process of detecting abnormal symptom of driving unit in unlocked section and activated section.

FIG. 8 is a graph illustrating process of detecting abnormal symptom of driving unit in unlocked section and activated section.

Figure 9:
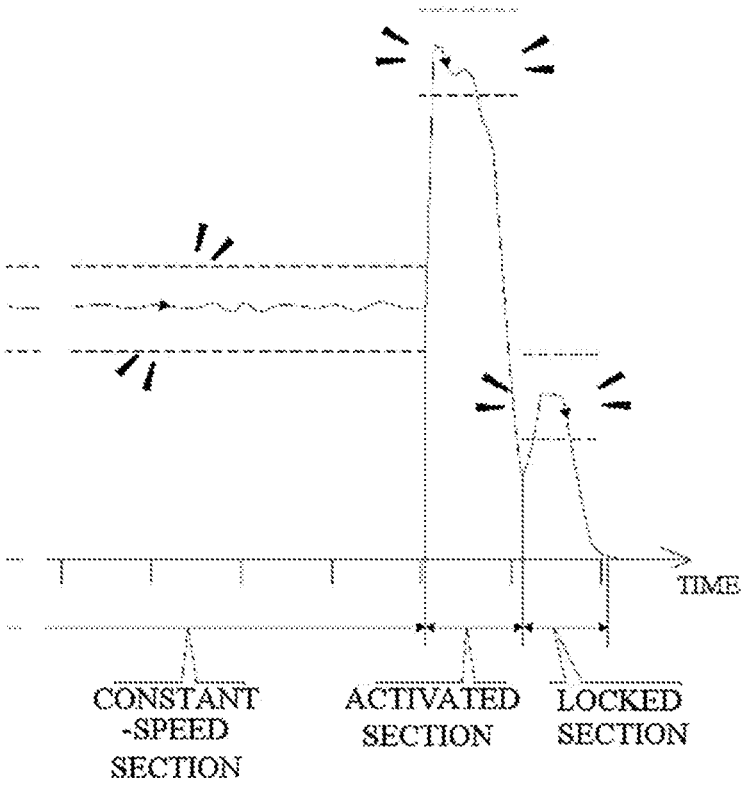
FIG. 9 is a graph illustrating process of detecting abnormal symptom of driving unit in constant-speed section, stopped section, and locked section.

FIG. 9 is a graph illustrating process of detecting abnormal symptom of driving unit in constant-speed section, stopped section, and locked section.

As illustrated in FIGS. 8 and 9, the third process S43 of the detection step S40 precisely and clearly detects the abnormal symptom of the driving unit by comparing the current values over time of the driving unit, which operates in real time, and the upper limit values and the lower limit values of the critical levels which are set for the respective sections.

Figure 10:
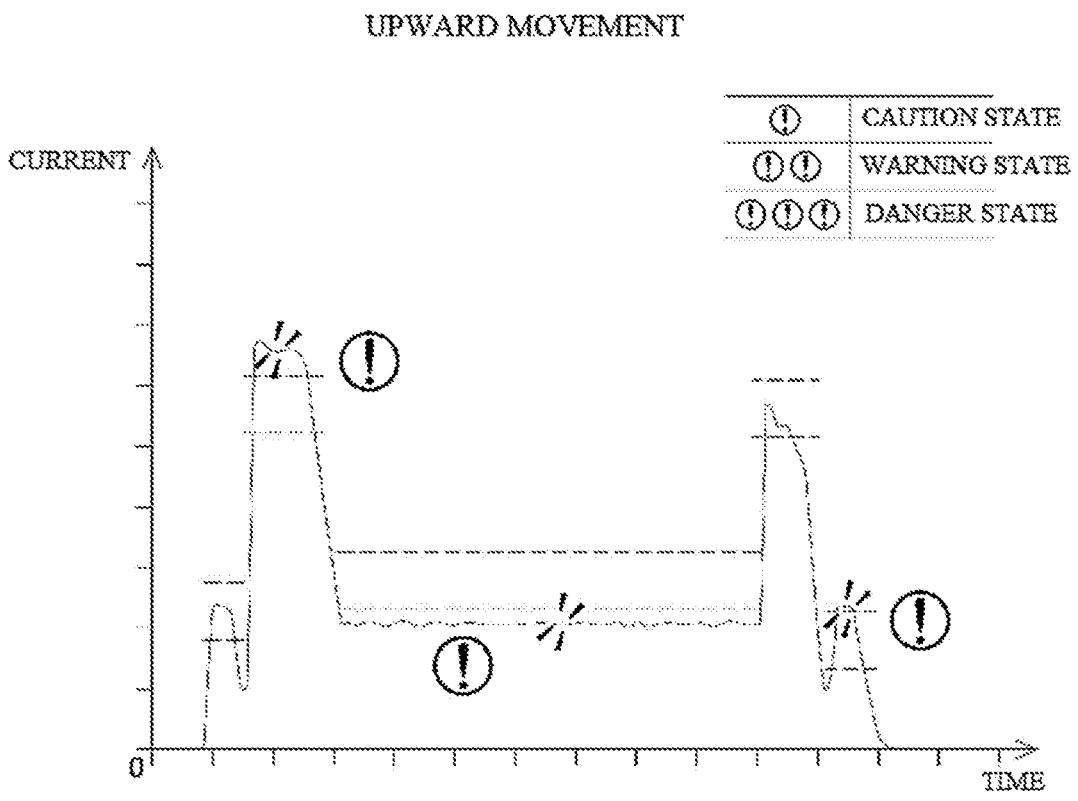
FIG. 10 is a graph illustrating detection of abnormal symptom of driving unit.

FIG. 10 is a graph illustrating detection of abnormal symptom of driving unit.

Since the abnormal symptom is detected for each section based on the driving information of the driving unit which operates in real time, the section in which the abnormal symptom is detected may be clearly recognized as illustrated in FIG. 10. As a result, it is possible to implement a stable management by performing the accurate and precise predictive maintenance of the elevator driving unit by easily detecting, based on the detected information, a device (part) of the driving unit which is suspected of having an abnormal symptom.

Meanwhile, it is possible to implement an effect management of the driving unit by setting a dangerous level for each step in a way in which a state of the driving unit is detected as a caution state when a real time current value of the driving unit is larger than the upper limit value of the critical level or smaller than the lower limit value of the critical level in one section, a state of the driving unit is detected as a warning state when the real time current value of the driving unit is larger than the upper limit value of the critical level or smaller than the lower limit value of the critical level in two sections, and a state of the driving unit is detected as a danger state when the real time current value of the driving unit is larger than the upper limit value of the critical level or smaller than the lower limit value of the critical level in three or more sections.

Here, the information, which is detected as described above, is of course transmitted to an elevator manager in a wired or wireless communication manner to allow the elevator manager to quickly cope with the situation in which the abnormal symptom of the elevator is detected.

The method of predictively maintaining an elevator driving unit according to the present invention, which detects the abnormal symptom of the elevator driving unit through the above-mentioned processes, distinguishes between the condition when moving the elevator upward and the condition when moving the elevator downward, collects the driving information of the driving unit (the information on the change over time in current values) in the normal state, collects the driving information of the driving unit before the occurrence of breakdown, sets the critical levels based on the collected information, detects in real time the abnormal symptom of the driving unit by comparing the driving information of the driving unit, which is collected in real time, with the set critical level, and then performs the stable predictive maintenance of the elevator driving unit, and as a result, the method of predictively maintaining an elevator driving unit according to the present invention has an effect of efficiently preventing a safety accident of the elevator caused by a breakdown of the elevator driving unit.

In addition, based on the characteristics in which the driving unit is applied to the elevator, the method of predictively maintaining an elevator driving unit according to the present invention collects the current values (the driving information) of the driving unit, which change over time, while classifying the current values into the unlocked section, the activated section, the constant-speed section, the stopped section, and the locked section, detects the abnormal symptom of the driving unit by comparing the driving information of the driving unit, which is collected in real time, with the upper limit values and the lower limit values of the critical levels corresponding to the respective sections, and thus may easily detect the part (device) of the driving unit which is suspected of having the abnormal symptom, and as a result, the method of predictively maintaining an elevator driving unit according to the present invention has an effect of performing the precise predictive maintenance of the driving unit of the elevator and ensuring excellent reliability associated with the detection result regarding the elevator driving unit.

While the present disclosure has been described with reference to the exemplary embodiments illustrated in the accompanying drawing, the exemplary embodiments are described just for illustration, the present disclosure is not limited to the exemplary embodiments, and those skilled in the art will understand that various modifications of the exemplary embodiments and any other exemplary embodiment equivalent thereto are available. In addition, the present disclosure may be modified by those skilled in the art without departing from the spirit of the present disclosure. Accordingly, the scope of the present disclosure is not limited to the scope of the detailed description but should be determined by the appended claims and the technical spirit of the claims.

What is claimed is:

1. A method of predictively maintaining an elevator driving unit that moves an elevator upward or downward, the method comprising:

a first base information collecting step S10 of measuring information on a change over time in magnitudes of current values of the driving unit when the driving unit moves the elevator upward in a normal state, measuring the information on the change over time in magnitudes of current values of the driving unit when the driving unit moves the elevator downward in the normal state, classifying the measured driving information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit;

a second base information collecting step S20 of measuring the information on the change over time in magnitudes of current values which is measured in an operated state of the driving unit before the driving unit breaks down when moving the elevator upward, measuring the information on the change over time in magnitudes of current values which is measured in the operated state of the driving unit before the driving unit breaks down when moving the elevator downward, classifying the measured information into information of the driving unit when moving the elevator upward and information of the driving unit when moving the elevator downward, and storing the information of the driving unit when moving the elevator upward and the information of the driving unit when moving the elevator downward as the base information of the driving unit;

a setting step S30 of setting, based on the information collected in the base information collecting steps S10 and S20, critical levels of the current values over time of the driving unit when moving the elevator upward and critical levels of the current values over time of the driving unit when moving the elevator downward; and a detection step S40 which includes: a first process S41 of measuring and collecting the information on the change over time in magnitudes of current values which is measured in the operated state of the driving unit in real time when the driving unit operates; a second process S42 of identifying the upward movement or the downward movement of the elevator by comparing the measured information collected in the first process S41 with the base information collected in the first base information collecting step S10; and a third process S43 of detecting an abnormal symptom of the driving unit by comparing the critical level of the setting step S30, which corresponds to the identified information identified in the second process S42, with the measured information collected in the first process S41.

2. The method of claim 1, wherein the information on the change over time in magnitudes of current values of the driving unit, which is collected in the base information collecting steps S10 and S20, is classified into an unlocked section in which a brake of the elevator is unlocked to allow the elevator to move upward or downward, an activated section in which the driving unit begins to operate to move the elevator upward or downward, a constant-speed section in which the current values of the driving unit are stabilized and maintained within a predetermined range during the process of moving the elevator upward or downward, a stopped section in which the driving unit stops operating to stop the elevator, and a locked section in which the brake of the elevator is locked, the setting step S30 sets upper limit values and lower limit values of the critical levels for the unlocked section, the activated section, the constant-speed section, the stopped section, and the locked section, and the third process S43 of the detection step S40 detects the abnormal symptom by comparing the current values over time of the driving unit, which operates in real time, with the upper limit values and the lower limit values of the critical levels for the respective sections, in which a state of the driving unit is detected as a caution state when a real time current value of the driving unit is larger than the upper limit value of the critical level or smaller than the lower limit value of the critical level in one section, a state of the driving unit is detected as a warning state when the real time current value of the driving unit is larger than the upper limit value of the critical level or smaller than the lower limit value of the critical level in two sections, and a state of the driving unit is detected as a danger state when the real time current value of the driving unit is larger than the upper limit value of the critical level or smaller than the lower limit value of the critical level in three or more sections.

* * * * *